United States Patent [19]

Kobayashi et al.

[11] Patent Number: 4,607,650

[45] Date of Patent: Aug. 26, 1986

[54] COIN DISPENSING APPARATUS

[75] Inventors: Osamu Kobayashi; Koji Yukimoto; Mitsugu Mikami, all of Saitama, Japan

[73] Assignee: Kabushiki Kaisha Nipponcoinco, Tokyo, Japan

[21] Appl. No.: 647,616

[22] Filed: Sep. 5, 1984

[30] Foreign Application Priority Data

Sep. 6, 1983 [JP] Japan ..... 58-162541
Sep. 14, 1983 [JP] Japan ..... 58-141545[U]
Sep. 28, 1983 [JP] Japan ..... 58-178251

[51] Int. Cl.[4] ..... G07D 1/02

[52] U.S. Cl. ..... 133/5 R; 221/13; 221/197

[58] Field of Search ..... 133/5 R, 4 R, 4 A, 3 R, 133/3 A, 3 B, 3 C, 3 D, 3 G, 1 A, 8 A, 2; 194/1 C, 1 F, 1 G, 1 K, 346; 221/2, 4, 7, 8, 9, 13, 21, 197

[56] References Cited

U.S. PATENT DOCUMENTS 2,618,280 11/1952 York ..... 133/5 R
3,844,298 10/1974 Schweitzer ..... 133/5
3,942,543 3/1976 Crowell et al. ..... 133/2
4,221,376 9/1980 Handen et al. ..... 221/9 X
4,250,905 2/1981 Kobayashi et al. ..... 133/5 R
4,254,787 3/1981 Watanabe et al. ..... 133/8 A
4,361,161 11/1982 Johnson ..... 194/1 C X
4,374,529 2/1983 Kobayashi et al. ..... 133/4 A
4,518,001 5/1985 Branham ..... 133/5 R

*Primary Examiner*—Joseph J. Rolla
*Assistant Examiner*—Edward S. Ammeen
*Attorney, Agent, or Firm*—Koda and Androlia

[57] ABSTRACT

A coin tube cassette is detachably mounted in a coin dispensing apparatus and has a plurality of coin tubes for storing coins in the direction of thickness thereof and coin shoots in units of denominations of coins stored in the radial direction thereof. The coins are automatically replenished by coin selector gates in the coin tubes or the coin shoots until they become full. A selected coin is discharged from the coin tube or the coin shoot in response to a code set by a code setter in accordance with the type of the tube cassette and the denominations of coins stored in the coin tubes. Coin dispensing is performed by a rotary disk having grooves for receiving coins and a coin selection plates having slits. The coin tube or the coin shoot is selected by a single solenoid.

10 Claims, 16 Drawing Figures

FIG.9-b
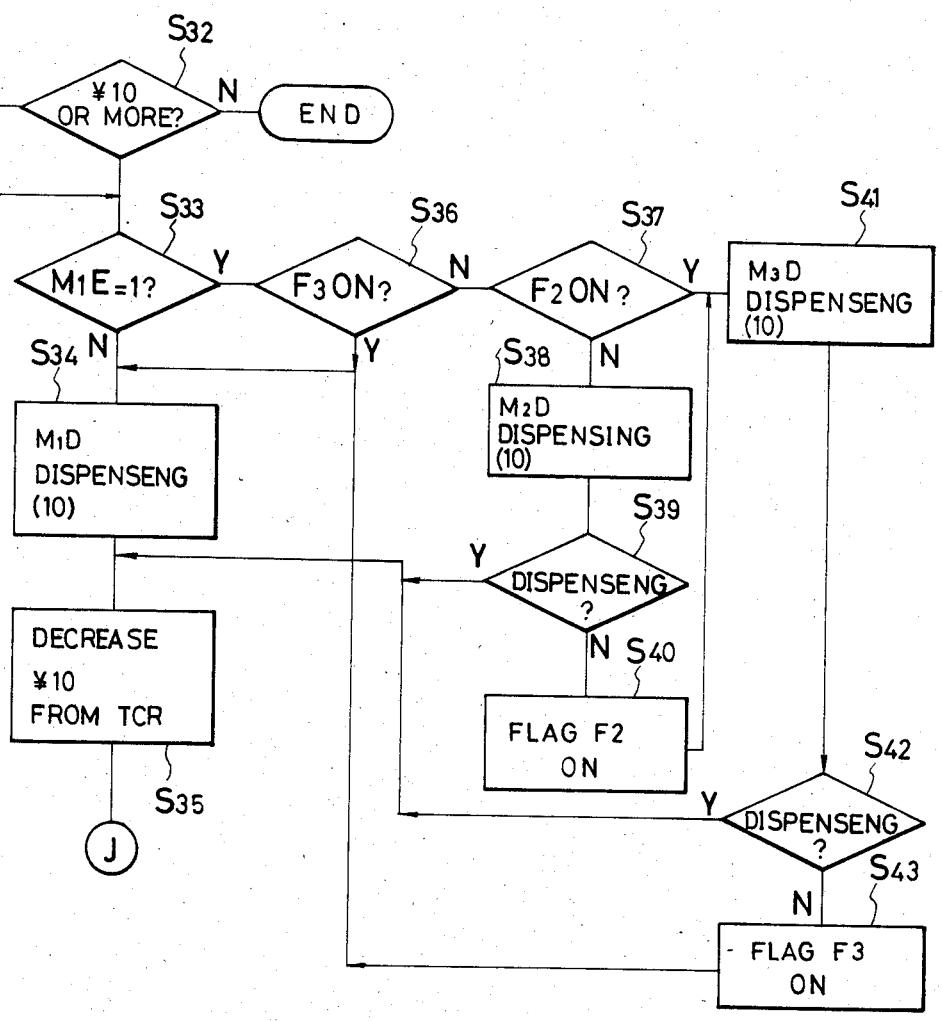

COIN DISPENSING APPARATUS

BACKGROUND OF THE INVENTION

The present invention relates to a coin dispensing apparatus for a vending machine or an exchange machine.

A conventional coin dispensing apparatus in a vending machine or an exchange machine has coin tubes in units of denominations. For example, coin dispensing mechanisms for coin tubes of ¥10, ¥50 and Y100 coins are respectively actuated to dispense the Y10, ¥50 and ¥100 coins. However, only ¥10 coins, only ¥10 and ¥100 coins, or frequently ¥10 coins and rarely ¥10 and ¥100 coins are used in accordance with the type of vending machine or exchange machine. In this manner, the types of coins and their dispensing frequency vary in accordance with the prices of items sold in vending machines and the like.

For this reason, only coins of a predetermined denomination are dispensed, and there becomes a shortage thereof. As a result, the operation efficiency of vending machines is degraded. In order to prevent this, the number of coin tubes for frequently dispensed coins is increased to increase the number of coins which are most frequently dispensed in accordance with the prices of items to be sold. For this purpose, different coin dispensing apparatuses must be manufactured in accordance with the coin tubes since the coin dispensing mechanisms and the coin dispensing control devices for the different configurations of the coin tubes must vary. However, different coin dispensing apparatuses have disadvantages in maintenance and changes in coins to be dispensed upon changes in prices of items to be sold.

Two conventional coin dispensing systems have been proposed: a dispensing method in which a coin is dispensed from a coin tube having coins stacked in the direction of thickness thereof; and a dispensing method in which a coin is dispensed from a coin shoot having coins stacked in the radial direction thereof. In a conventional coin dispensing apparatus for dispensing coins from the coin shoot, a lever and a pin extend inside the coin shoot, and the lever and the pin are alternately brought into the coin shoot or are moved away from the coin shoot by means of solenoids to dispense a predetermined number of coins. Since the lever and the pin are slid into or away from the coin shoot, the sliding surfaces of the lever and the pin are easily contaminated with dust and dirt. Even if the solenoid is operated, the lever and the pin may not be projected into or away from the coin shoot. In addition, when different coins are dispensed from a plurality of coin shoots, the different coin shoots cannot be arranged in an overlap manner. As a result, a compact dispensing apparatus cannot be manufactured.

SUMMARY OF THE INVENTION

It is a first object of the present invention to solve conventional drawbacks and to provide a coin dispensing apparatus wherein coin tubes each comprise a detachable coin tube cassette to change the number of coins of a predetermined denomination to be used.

It is a second object of the present invention to provide a coin dispensing apparatus capable of automatically replenishing coins inserted in the coin tubes in the coin tube cassette.

It is a third object of the present invention to provide a coin dispensing apparatus having a coin tube for storing coins in the direction of thickness thereof and a coin shoot for storing coins in the radial direction thereof.

It is a fourth object of the present invention to provide a coin dispensing apparatus wherein the inserted coins can be selectively and automatically replenished in the coin tube or coin shoot in accordance with the types of coin tube cassettes.

It is a fifth object of the present invention to provide a coin dispensing apparatus wherein coins are selectively dispensed from the plurality of coin shoots.

It is a sixth object of the present invention to provide a coin dispensing apparatus wherein coin selecting means comprises a single solenoid for dispensing the plurality of coin tubes or the plurality of coin shoots.

In order to achieve the above objects of the present invention, there is provided a coin dispensing apparatus, wherein a coin tube cassette having a plurality of coin tubes for storing coins in the direction of thickness thereof is detachably mounted in the apparatus, and there are also provided coin shoots for storing coins in the radial direction thereof, the coin shoot being mounted in the coin dispensing apparatus or the coin tube cassette. The coin tube cassette is made up from a combination of two types of coin tubes for automatically replenishing the coin inserted and selected by a coin selector gate disposed in the coin tube cassette in the coin tubes or coin shoots. Codes are set by code setting means in accordance with the types of the coin tube cassette and types of coin stored in the respective coin tubes in the coin tube cassette. A controlling means controls dispensing of coins from the respective coin tubes and the respective coin shoots in accordance with the code. Coin discharge ports of the coin shoots for storing coins in the radial direction thereof are overlapped in the direction of thickness of the coin. There are provided a rotary disk having grooves for receiving a coin from the coin dispensing ports, and at least one sliding plate having an aperture for passing a coin below the rotary disk. The position of the sliding plate is controlled by the solenoid, and the rotary disk is driven by a first motor to dispense a selected coin. The solenoid for driving the sliding plate is operated such that a change lever of a conventional coin dispensing mechanism for dispensing coins from the respective coin tubes for storing coins in the direction of thickness is moved to select a coin tube from which coins are to be dispensed by a second motor.

With the above construction, when a desired coin tube cassette is selected and is loaded in the coin dispensing apparatus in accordance with the type of coin to be dispensed, the controlling means selectively dispenses coins from the coin tube or the coin shoot in accordance with the code from the code setting means. For this reason, the tube cassette is selected and mounted in accordance with prices of items to be sold by a vending machine or the like. In this manner, the number of most frequently used coins is increased to prevent a shortage thereof. The coin dispensing apparatus can handle the case wherein prices of items to be sold by the vending machine change without modification to its construction, thereby improving the utilization efficiency of the vending machine.

When coins are dispensed from the coin shoot for storing coins in the radial direction, a coin is inserted in a motor-driven rotary disk and is then dispensed. Unlike the pin and the lever which are subjected to sliding, failure of operation caused by dust and dirt can be prevented. Furthermore, even if a plurality of types of coins are used, the coin shoots of the respective denominations can be overlapped, and concentrated at a single location, thereby thus providing a compact coin dispensing apparatus.

Furthermore, the coins from the coin tube and the coin shoot can be dispensed by the single solenoid as the selecting means, so that the coin dispensing apparatus becomes compact and low cost.

DETAILED DESCRIPTION OF THE PREFERRED EMBODIMENTS

Figure 1:
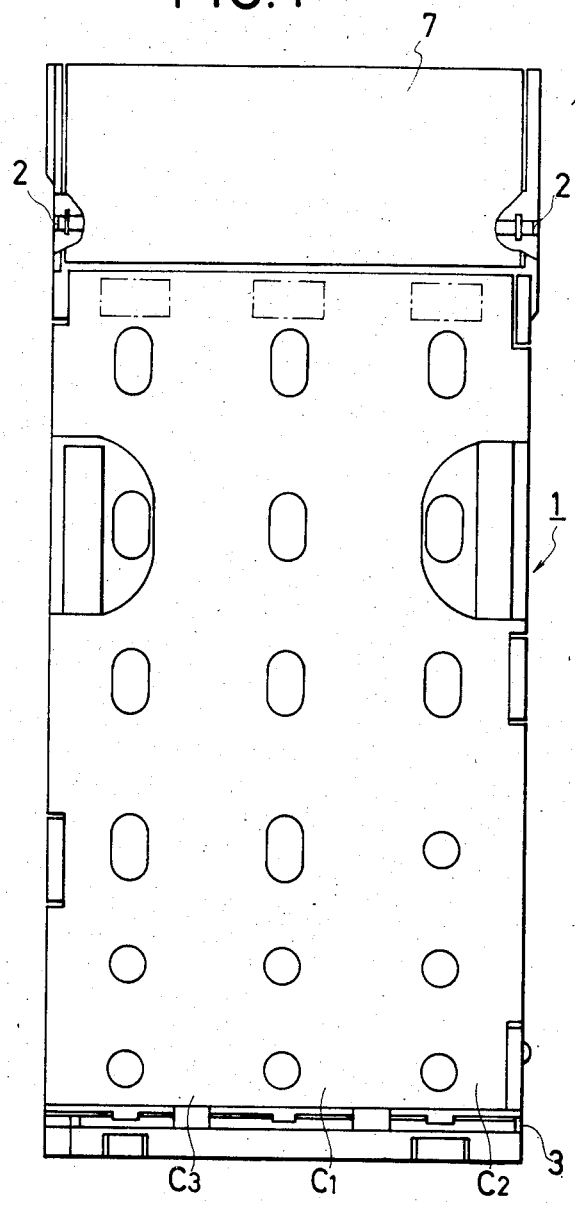
FIG. 1 is a plan view showing a coin tube cassette used in a coin dispensing apparatus according to a first embodiment of the present invention.
Figure 2:
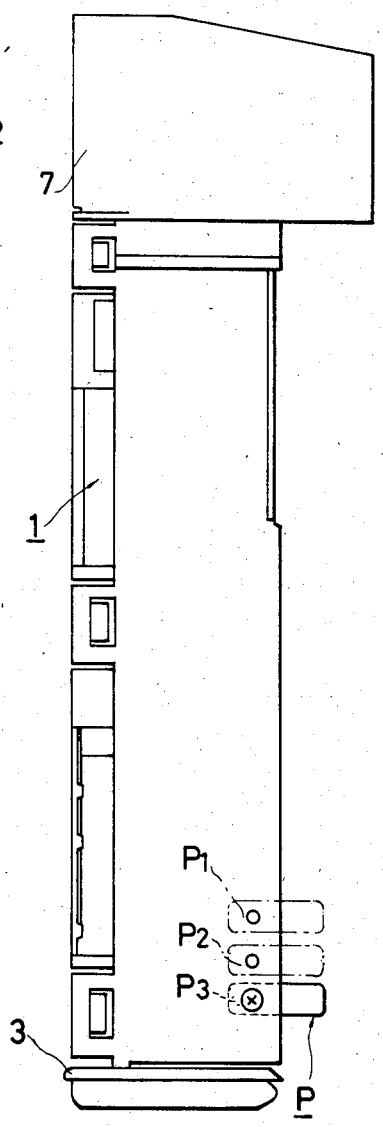
FIG. 2 is a side view of the coin tube cassette shown in FIG. 1.
Figure 3:
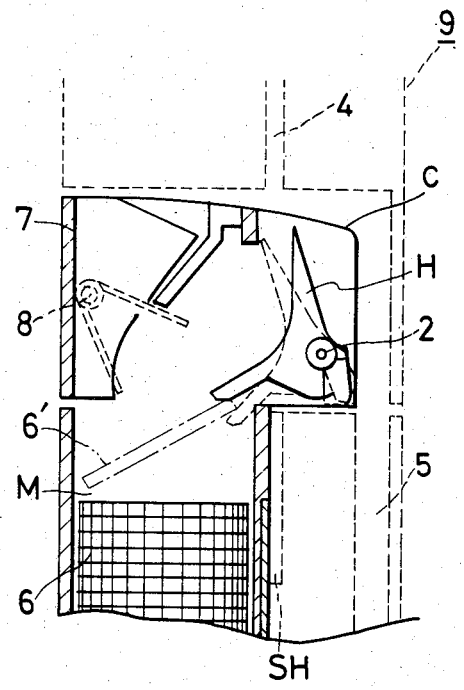
FIG. 3 is a sectional view of a first type coin tube.
Figure 4:
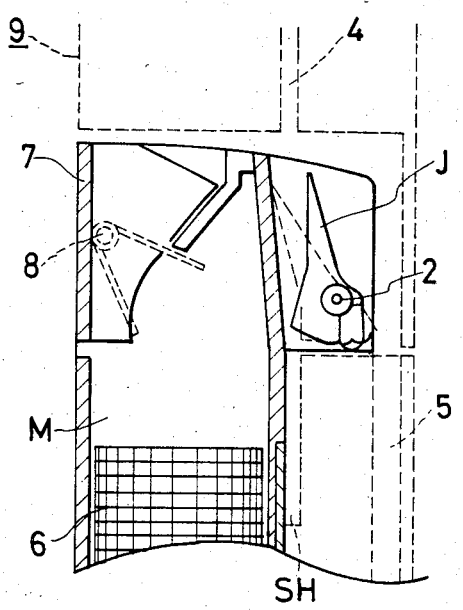
FIG. 4 is a sectional view of a second type coin tube.

FIG. 1 is a plan view showing a coin dispensing apparatus which detachably adopts a coin tube cassette according to a first embodiment of the present invention, and FIG. 2 is a side view thereof. A tube cassette 1 has three coin tubes C1, C2 and C3. Pay-out sliding plates 3 are respectively mounted at the lower portions of the coin tubes C1 to C3 to receive the coins in the coin tubes and feed the received coins to the coin dispensing apparatus when the coin tube cassette 1 is mounted in a coin dispensing apparatus 9. These coin tubes C1 to C3 are located at positions corresponding to the coin paths of different denominations when the coin tube cassette 1 is mounted in the coin dispensing apparatus 9 and the coins are dispensed from the cassette to the apparatus. In this embodiment, the coin tubes C1, C2 and C3 correspond to ¥10, ¥50 and ¥100 coin paths to receive coins, respectively. The coin tubes C1 to C3 may be a first type whose cross section is illustrated in FIG. 3 or a second type whose cross section is illustrated in FIG. 4. The coin tube cassette 1 is a combination of three coin tubes out of six coin tubes consisting of three first type coin tubes and three second type coin tubes. A coin tube C of the first type shown in FIG. 3 has a coin selector gate H for selecting coins 6 dropped through a coin path 4 of the coin dispensing apparatus 9 into a storage compartment M of the coin tube C and a path 5 for guiding the coins into a safe in the coin dispensing apparatus 9. The coin selector gate H is normally located at the side corresponding to the storage compartment M of the coin tube C. However, when the storage compartment M of the coin tube C becomes full, and an uppermost coin 6' indicated by the broken line moves the coin selector gate H to the position shown by the dotted line, the subsequent coins 6 are sent along the path 5. The second type coin tube shown in FIG. 4 has a coin selector gate J which will not automatically replenish the coin compartment M of the coin tube C with the coins 6 dropping along the coin path 4. The coin selector gate J guides the coins to the path 5 for guiding the coins in a storage shoot SH and a safe which stores coins in the radial direction thereof. The coins 6 can be manually stored in the coin storage compartment M of the coin tube C. Reference numeral 7 denotes a loading shoot which can be pivoted about a shaft 8, so that the coins can be manually replenished into the respective tubes.

Figure 5:
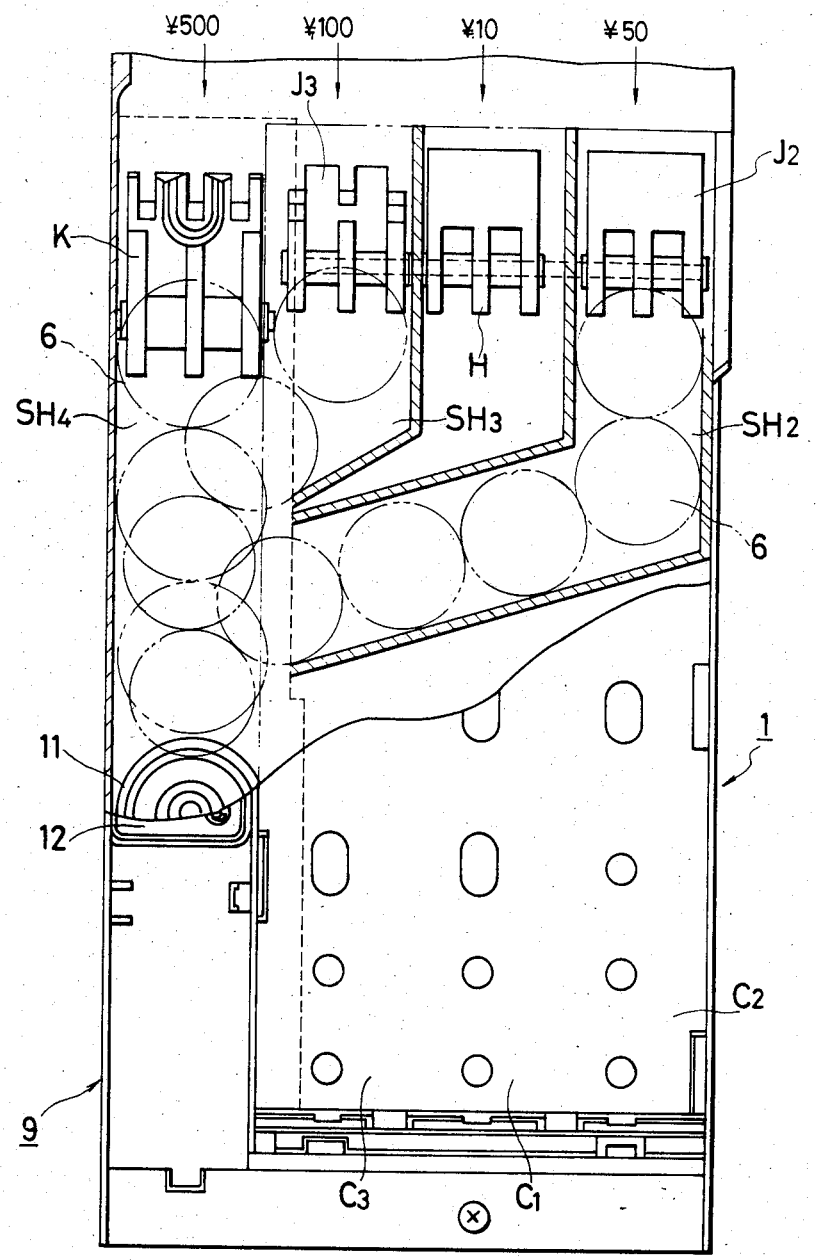
FIG. 5 is a representation for explaining coin storage into a coin shoot in the coin dispensing apparatus which adopts the tube cassette according to the present invention.

The coin tube cassette 1 comprises a combination of the first and second type coin tubes. For example, when all the tubes comprise the first type coin tubes, the coin cassette becomes the same as the conventional arrangement. However, when ¥10 coins are frequently used, and ¥50 and ¥100 coins are rarely used, the tube cassette 1 may comprise the coin tube C1 as the first type tube, and coin tubes C2 and C3 as second type tubes, as shown in FIG. 5. ¥10 coins are manually stored in the coin storage compartments M of the coin tubes C2 and C3. The ¥10 coins are dispensed from the coin tubes C1 to C3. In this case, ¥50 coins dropping in the coin tube C2 are replenished in a storage shoot SH2. When the storage shoot SH2 becomes full, a coin selector gate J2 selects the coin path 5 to the safe and subsequent coins are sent thereto. The ¥100 coins dropping in the coin tube C3 are handled in the same manner as described above.

A desired coin tube cassette 1 having a proper combination of the first and second type coin tubes is selected and is mounted in the coin dispensing apparatus 9. A code setting section P in a code setting means is arranged on a tube cassette surface at which the coin dispensing apparatus 9 and the tube cassette 1 contact each other, so as to set a code in accordance with a combination of the first and second type coin tubes and types of coins stored in the respective coin tubes. A code reading section Q (not shown) is formed on the coin dispensing apparatus 9 at a position corresponding to the code setting section P. In this embodiment, the code setting section P is constituted by an array of projections P1 to P3, and the code reading section Q is constituted by grooves to be engaged with the projections P1 to P3. Photosensors (not shown) are arranged to detect whether or not the projections P1 to P3 are fitted in the grooves. Pressure-sensitive elements or microswitches may be used in place of the photosensors.

A ¥500 storage shoot SH4, a ¥100 storage shoot SH3 and the storage shoot SH2 which stores ¥50 coins are arranged in the coin dispensing apparatus, as shown in FIG. 5. The respective storage shoots SH2, SH3 and SH4 guide the coins in a shoot coin discharging unit 10 arranged at the side of mounting section of the coin tube cassette 1. More particularly, the coin tubes C2 and C3 comprise the second type coin tubes shown in FIG. 4, and the coin tube C1 comprises the first type tube shown in FIG. 3 so as to constitute the coin tube cassette 1, as shown in FIG. 5. The coin selector gates J2 and a coin selector gate J3 of the coin tubes C2 and C3 automatically replenish the ¥50 and ¥100 coins in the ¥50 and ¥100 storage shoots SH2 and SH3, respectively. The coin selector gate H of the coin tube C1 automatically replenishes ¥10 coins fed thereto in the storage compartment M of the coin tube C1. All the coin storage compartments of the coin tubes C1 to C3 store ¥10 coins. ¥10 coins are manually stored from the loading shoot 7 to the coin tubes C2 and C3. Reference numeral K denotes a coin selector gate for guiding the Y500 coins to the path 5 for the safe when the ¥500 storage shoot SH4 becomes full of ¥500 coins.

Figure 6:
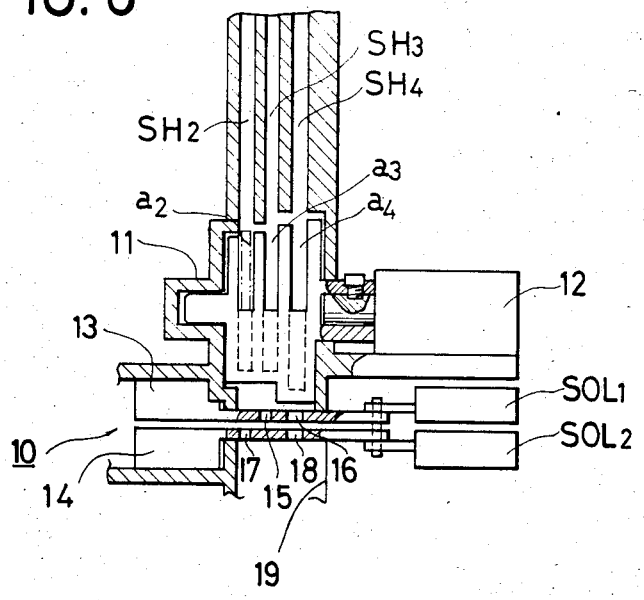
FIG. 6 is a view showing the first embodiment of a coin discharging unit from the coin shoot.

The coins stored radially in the storage shoots SH2, SH3 and SH4 are dispensed by the shoot coin discharging unit 10 shown in FIG. 6. The shoot coin discharging unit 10 comprises a rotary drum 11 with grooves a2, a3 and a4 for receiving the coins from the respective shoots, a motor 12 for rotating the rotary drum 11 through a transmission mechanism, and coin selection plates 13 and 14 for selectively discharging coins from the rotary drum 11 to a coin discharge port 19. The coin selection plates 13 and 14 have slits 15 and 16 and slits 17 and 18 for passing coins therethrough, respectively. Solenoids SOL1 and SOL2 are selectively energized to change the slit positions, thereby selectively discharging the coins. In the state shown in FIG. 6, the slit 16 is aligned with the slit 18. When the motor 12 is rotated in this state, only the ¥500 coin in the groove a4 is discharged from the coin discharge port 19. However, when only the solenoid SOL1 is driven to move the coin selection plate 13 to the left in FIG. 6, the slit 15 is aligned with the slit 17. When the motor 12 is rotated, only the ¥50 coin in the groove a2 is discharged from the coin discharge port 19. When only the solenoid SOL2 is energized, the slit 15 is aligned with the slit 18, so that only the ¥100 coin is discharged from the coin discharge port 19.

In this embodiment, the above-mentioned shoot coin discharging unit 10 is used to dispense the coins from the storage shoot. However, a conventional coin discharging unit may be used to discharge coins one by one by inserting a stopper pin in each shoot in the conventional manner.

The coin discharging unit from storage compartments M1 to M3 of the coin tubes C1 to C3 comprises a conventional coin discharging unit, and a detailed description thereof will be omitted.

Figure 7:
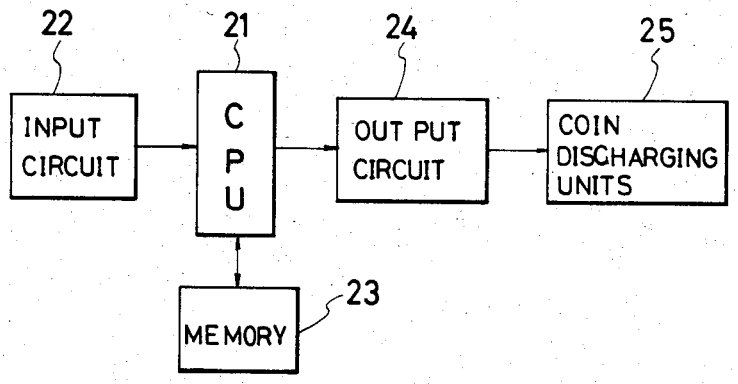
FIG. 7 is a block diagram of a control section of the coin dispensing apparatus shown in FIG. 5.

FIG. 7 is a control circuit of a coin dispensing apparatus using the coin tube cassette of this embodiment. Reference numeral 21 denotes a CPU (central processing unit); 22, an input circuit for receiving a signal from the code reading section Q, a signal from a coin dispensing confirmation switch, a signal from a coin empty switch of the storage compartment M1 of the ¥10 coin tube, and input data representing the types of coins used in the coin dispensing apparatus and the amount of inserted coins. Reference numeral 23 denotes a memory. The memory 23 has tube registers M2R and M3R and shoot registers S2R, S3R and S4R which store data representing the number of coins stored in the storage shoots SH2 and SH3 for storing the coins of the coin compartments M2 and M3 of the ¥50 and ¥100 coin tubes C2 and C3 and in the storage shoots SH4 for Y500 coins. Each of the tube and shoot registers M2R, M3R, S2R, S3R and S4R is decremented by one when a coin is dispensed from the corresponding coin tube storage compartment or the storage shoot. When a coin is automatically replenished in the storage compartment of the coin tube or storage shoot through the coin path 4, the corresponding register is incremented by one. However, the counts of the respective registers will not exceed the full state of the corresponding storage compartments and the corresponding storage shoots (i.e., the coins cannot be replenished in the compartments and the shoots). The memory 23 has a total amount calculation register TCR. A total amount of dispensed coins is calculated by this total amount calculation register TCR. Reference numeral 24 denotes an output circuit; and 25, a coin discharging unit.

Figure 8:
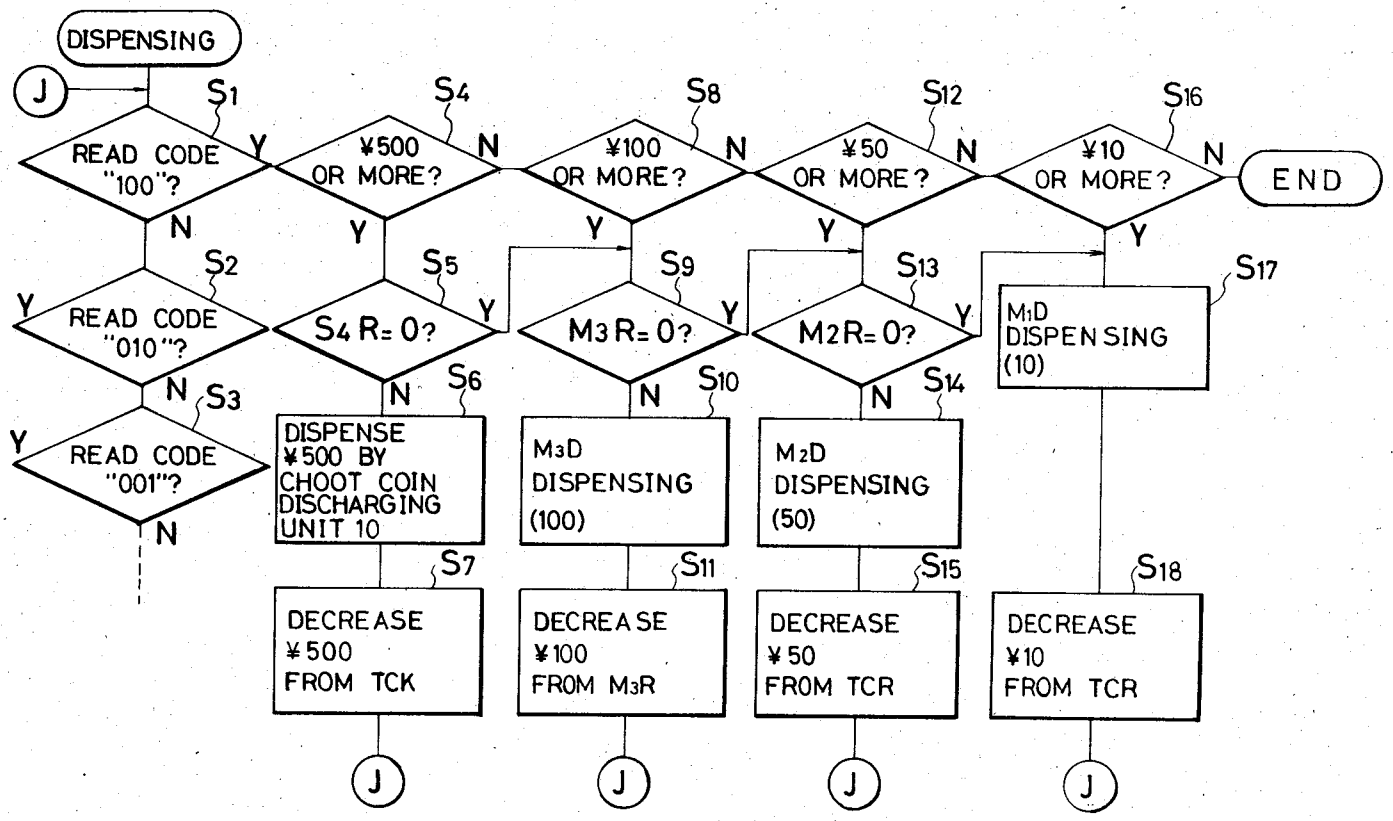
FIG. 8 is a flow chart for explaining the operation of the apparatus when ¥10, ¥50 and ¥100 coins are stored in the respective coin tubes, respectively.

The operation of the coin dispensing apparatus will now be described. Assume that the tube cassette 1 has the coin tube C1 as the ¥10 coin tube of the first type, the coin tube C2 as the ¥50 coin tube of the first type, and the coin tube C3 as the ¥100 coin tube of the first type. Also assume that the code setting section P of the coin tube cassette 1 generates a code "100". When a coin dispensing instruction is supplied to the coin dispensing apparatus having the above-mentioned tube cassette 1, the CPU 21 checks in step S1 whether or not the code from the code setting section P is "100", as shown in FIG. 8. If YES or Y in step S1, the CPU 21 then checks in step S4 whether or not a total amount of coins to be dispensed exceeds ¥500. If YES in step S4, the CPU 21 checks in step S5 whether or not the shoot register S4R is zero. If NO in step S5, a ¥500 coin is stocked in the ¥500 coin storage shoot SH4. The CPU 21 then generates a ¥500 coin dispensing signal to drive the corresponding shoot coin discharging unit, thereby dispensing a ¥500 coin. More particularly, when the ¥500 coin dispensing signal is generated, the solenoids SOL1 and SOL2 are not energized, but only the motor 12 is rotated by one revolution. The ¥500 coin is then discharged from the coin discharge port 19 through the slits 16 and 18. An amount of ¥500 is decreased from data stored in the total amount calculating register TCR in the memory 23, and the ¥500 shoot register S4R is decremented by one in step S7. Thereafter, the operation is started from step S1. When a dispensing amount is less than ¥500 but more than ¥100, the CPU 21 checks in step S9 whether or not the ¥100 tube register M3R for storing the number of coins for the ¥100 storage compartment M3 is zero. If NO in step S9, the CPU 21 causes a coin discharging unit M3D of the compartment M3 of the ¥100 coin tube C3 to operate so as to dispense a ¥100 coin in step S10. The amount of ¥100 is decreased from the data stored in the total amount calculating register TCR, and the count of the ¥100 tube register M3R is decremented by one. Thereafter, the operation is restarted from step S1. The ¥100 tube register M3R counts the inserted ¥100 coins until the ¥100 coin storage compartment M3 becomes full. When the ¥100 storage compartment M3 becomes full, and the selector gate H is located, as indicated by the dotted line in FIG. 3, the subsequent Y100 coins are guided to the path 5 for the safe. In this case, the the count of the ¥100 tube register M3R will not be increased.

When the dispensing amount is less than ¥90 but more than ¥50, the CPU 21 checks in step S13 whether or not the ¥50 tube register M2R is zero. If NO in step S13, a coin discharging unit M2D of the ¥50 storage compartment M2 is operated to dispense a ¥50 coin in step S14. An amount of ¥50 is decreased from the data stored in the total amount calculating register TCR, and the count of the ¥50 tube register M2R is decremented by one in step S15. When a dispensing amount becomes less than ¥40, a coin discharging unit M1D of the Y10 storage compartment M1 is operated to dispense a Y10 coin. An amount of ¥10 is decreased from the total amount calculating register TCR. A ¥10 tube register for storing the number of coins stored in the storage compartment M1 in the ¥10 coin tube C1 is not arranged in the memory 23. When a remaining number of ¥10 coins becomes less than a predetermined number (e.g., 9), a ¥10 coin empty switch M1E is operated in this embodiment. When the CPU 21 receives the signal from the ¥10 coin empty switch M1E, the CPU 21 causes the vending machine to sell items with no ¥10 change. A ¥10 tube register may be arranged in place of the ¥10 coin empty switch M1E. In this embodiment, when coins of higher denominations become empty, the coin dispensing apparatus dispenses coins of lower denominations. In the above embodiment, after the coin discharging units M1D to M3D and the shut coin discharging unit 10 are operated, the total amount calculating register TCR, the respective tube registers M1R to M3R and the shoot register S4R are updated. However, data updating may be performed after a coin dispensing detection switch (not shown) arranged in the coin dispensing path detects coin dispensing.

An operation will be described wherein the coin tube cassette 1 having the coin tube C1 as the ¥10 tube of the first type, and the coin tubes C2 and C3 as the Y10 tubes of the second type is mounted in the coin dispensing apparatus, as shown in FIG. 5.

Since the coin tube C1 of the coin tube cassette 1 is of the first type, the ¥10 coins such as inserted coins dropping along the coin path 4 are automatically replenished in the storage compartment M1 in the coin tube C1. When the storage compartment M1 becomes full, ¥10 coins are guided along the path 5 by the selector gate H. Since the coin tubes C2 and C3 are of the second type, ¥50 and ¥100 coins dropping along the coin paths 4 of the corresponding coin tubes are guided by the selector gate J and are stored in the storage shoots SH2 and SH3 for storing coins in the radial directions thereof. When the storage shoots SH2 and SH3 become full, the corresponding coins are guided along the path 5 to the safe. The coin empty detection switch M1E is arranged only in the storage compartment M1 of the coin tube C1. When only nine coins are left in the main tube M1, the coin empty detection switch M1E is operated to generate the signal in the same manner as previously described.

Figure 9:
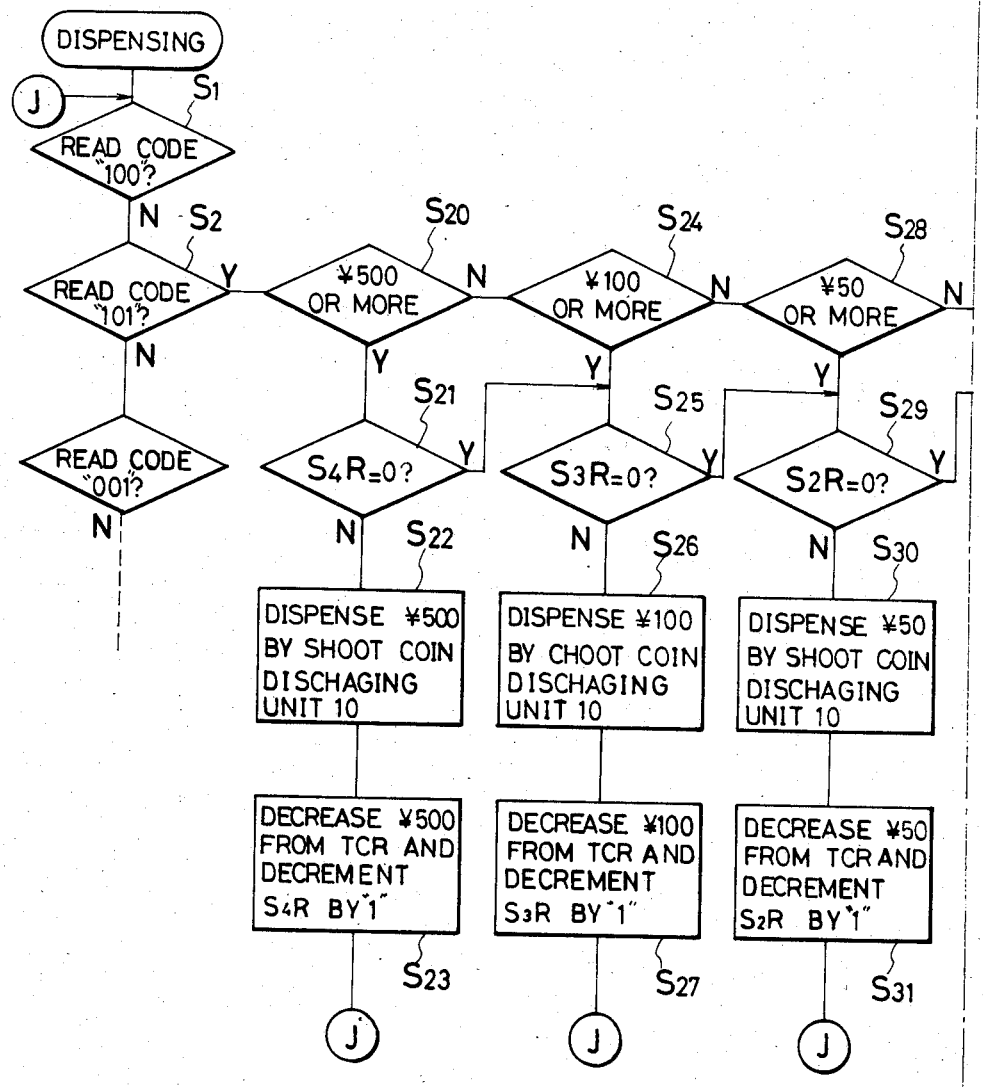
FIGS. 9*a* and 9*b* is a flow chart for explaining the operation of the apparatus when ¥10 coins are stored in all coin tubes.

When such a coin tube cassette 1 is mounted in the coin dispensing apparatus, a code "010" is set by the code setting section P. When the coin dispensing instruction is generated, the CPU 21 performs processing in accordance with the code "010", as shown in FIG. 9. When a dispensing amount exceeds ¥500, a ¥500 coin is dispensed in the same manner as in FIG. 8. Similarly, when a dispensing amount is less than ¥500 and is more than ¥100, the same operation as in FIG. 8 is performed, except that a ¥100 coin is dispensed from the storage shoot SH3 in FIG. 9 while a ¥100 coin is dispensed from the ¥100 storage compartment M3. When the ¥100 shoot register S3R is not zero in step S25, the shoot coin discharging unit 10 is operated to dispense the ¥100 coin from the ¥100 storage shoot SH3 in step S26. An amount of ¥100 is decreased from the data stored in the total amount calculating register TCR in the memory 23, and the count of the ¥100 shoot register S3R is decremented by one in step S27. Thereafter, the operation is restarted from step S1. When a dispensing amount is less than ¥90 but more than ¥50, the CPU 21 checks in step S29 whether or not the ¥50 shoot register S2R is zero. If NO in step S29, a ¥50 coin is dispensed from the ¥50 storage shoot SH2 in step S30. An amount of ¥50 is decreased from the data stored in the total amount calculating register TCR, and the count of the ¥50 shoot register S2R is decremented by one in step S31. When a dispensing amount is less than ¥40, the CPU 21 checks in step S33 whether or not the signal is generated from the ¥10 coin empty switch M1E. If NO in step S33, the coin discharging unit M1D of the storage compartment M1 of the coin tube C1 is operated to dispense a ¥10 coin in step S34. An amount of ¥10 is decreased from the data stored in the total amount calculating register TCR. When the number of coins stored in the storage compartment M1 in the ¥10 coin tube C1 becomes less than 9, the signal is generated from the ¥10 coin empty detection switch M1E. The CPU 21 then checks in step S36 whether or not a flag F3 in the memory is set at logic "1". If NO in step S36, the CPU 21 detects in step S37 whether or not a flag F2 is set at logic "1". If NO in step S37, the coin discharging unit M2D of the storage compartment M2 of the coin tube C2 is operated to dispense a ¥10 coin from the storage compartment in step S39. When the CPU 21 detects in step S39 that a coin has been dispensed in response to the signal from a coin dispensing detection switch (not shown) arranged in the coin dispensing path, an amount of ¥10 is decreased from the data stored in the total amount calculating register TCR. However, when the signal is not generated from the coin dispensing detection switch, the CPU 21 determines that the stored coins are not present in the storage compartment M2 of the coin tube C2. The CPU 21 then enables the flag F2 to operate the coin discharging unit M3D of the storage compartment M3 of the coin tube C3. A ¥10 coin is then dispensed from the storage compartment M3. When the CPU 21 detects in step S42 that the signal is generated from the coin dispensing detection switch, the amount of ¥10 is decreased from the data stored in the total amount calculating register TCR. Thereafter, since the flag F2 is set at logic "1", the coin dispensing unit of the storage compartment M3 is operated to dispense a ¥10 coin. When the ¥10 coin storage compartment M3 in the coin tube C3 becomes empty, the flag F3 is set at logic "1" , and the coin discharging unit M1D of the storage compartment M1 of the coin tube C1 is operated to dispense a ¥10 coin. Thereafter, when the flag F3 is set at logic "1" in step S36, the coin discharging unit M1D is operated to dispense a ¥10 coin, thereby completing one transaction. Since the flags F2 and F3 are set at logic "1", only subsequent transactions which do not involve ¥10 coins are performed.

The above operation is the case in which the coin tube cassette 1 having the coin tubes C1, C2 and C3 as ¥10 coin tubes is mounted in the coin dispensing apparatus.

Figure 10:
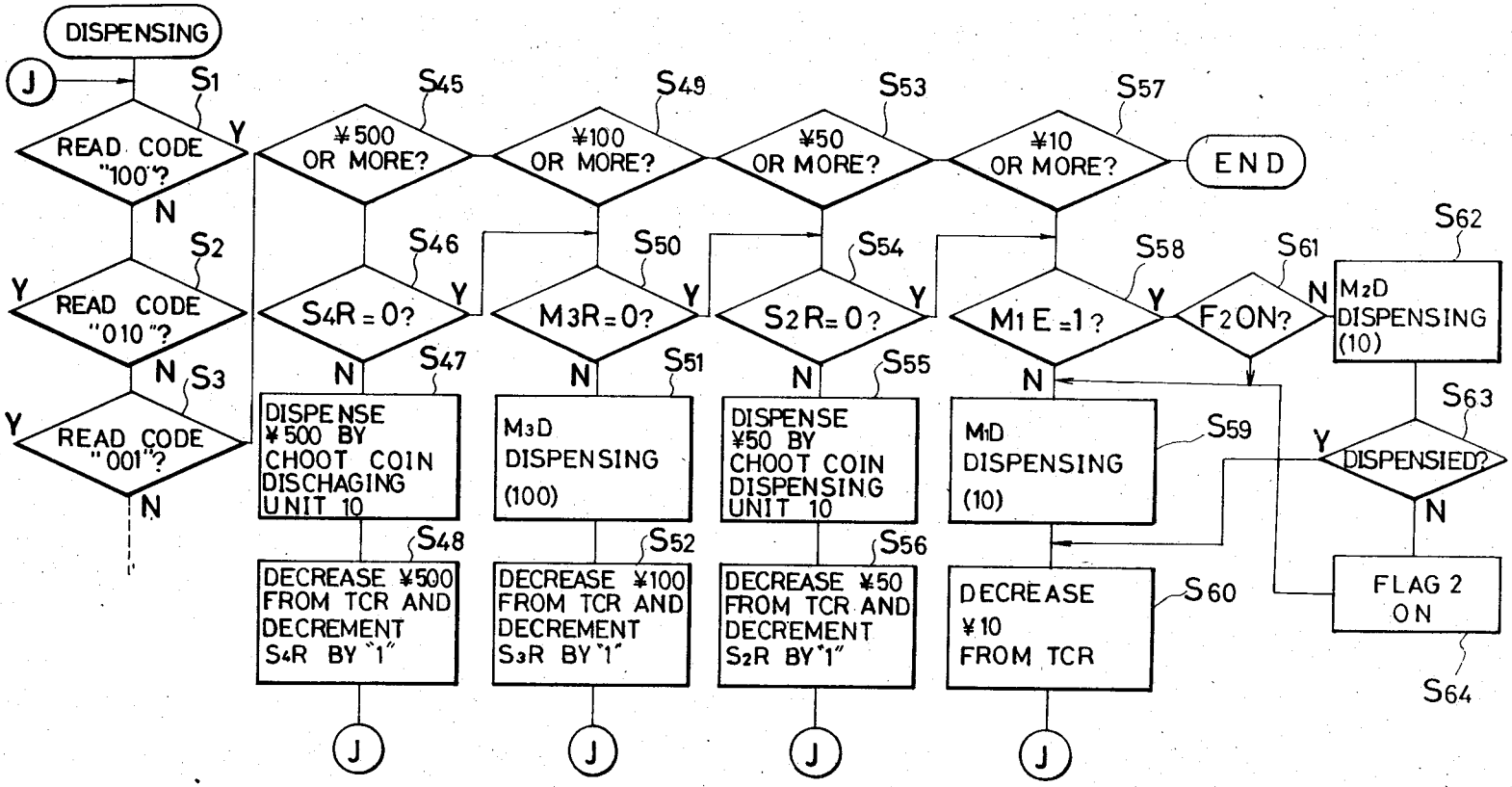
FIG. 10 is a flow chart for explaining the operation of the apparatus when ¥10, ¥50 and ¥100 coins are stored in the respective coin tubes.

An operation will be described wherein the coin tube cassette 1 having the coin tube C2 as a Y10 coin tube of the second type so as to store ¥10 coins in its storage compartment M2, the coin tube C1 as a ¥10 tube of the first type, and the coin tube C3 as a ¥100 tube of the first type is mounted in the coin dispensing apparatus, as shown in FIG. 10.

In this case, ¥10 and ¥100 coins are automatically replenished in the storage compartments M1 and M3 of the coin tubes C1 and C3, respectively. ¥50 coins are automatically replenished in the storage shoot SH2. This tube cassette has the code setting section P for setting a code "001". When a coin dispensing instruction is supplied to the coin dispensing apparatus having such a tube cassette 1, and this dispensing instruction represents a dispensing amount exceeding ¥500, a ¥500 coin dispensing signal is generated to dispense a ¥500 coin. However, when a dispensing amount is less than ¥500 but more than ¥100, the coin discharging apparatus M3D of the storage compartment M3 for storing ¥100 coins is operated. When the dispensing amount is less than ¥90 but more than ¥50, a ¥50 coin is dispensed from the ¥50 coin storage shoot SH2. When a dispensing amount is less than ¥40, the coin discharging unit for the storage compartment M1 for storing ¥10 coins is operated to dispense a ¥10 coin. However, when ¥10 coins are frequently dispensed and a number of ¥10 coins remaining in the storage compartment M1 in the ¥10 coin tube C1 becomes less than 9, the coin empty detection switch M1E is turned on to generate a signal in step S58. The CPU 21 detects in step S61 whether or not the flag F2 is set at logic "1". If NO in step S61, a ¥10 coin is dispensed from the storage compartment M2 in the coin tube C2 in step S62. The CPU 21 then checks in step S63 whether or not a coin has been dispensed in response to the signal from the coin dispensing detection switch. If YES in step S63, an amount ¥10 is decreased from data stored in the total amount calculating register TCR in step S60. However, if NO in step S63, the CPU 21 indicates that the ¥10 storage compartment M2 has become empty. The CPU 21 then causes the flag F2 to be set at logic "1" in step S64, and the coin discharging unit M1D of the storage compartment M1 in the coin tube C1 is operated to dispense a ¥10 coin in step S59. The ¥10 coin is dispensed by the coin discharging unit M1D of the storage compartment M1. The CPU 21 controls the transaction operations such that only transactions which do not involve ¥10 coins are performed until the coin empty detection switch M1E is turned off.

Three types of coin tube cassettes 1 are selectively loaded in the coin dispensing apparatus in the above description. However, another combination of first and second type coin tubes and another combination of different types of coins may be selected in accordance with a code set by the code setting section P in the code setting means. For example, when dispensing of only ¥100 coins is required, the coin tubes C1 and C2 comprise ¥100 tubes of the second type, and the coin tube C3 comprises a ¥100 tube of the first type. When dispensing of only ¥50 coins is required, the coin tubes C1 and C3 comprise ¥50 tubes of the second type, and the coin tube C2 comprises a ¥50 tube of the first type.

Figure 11:
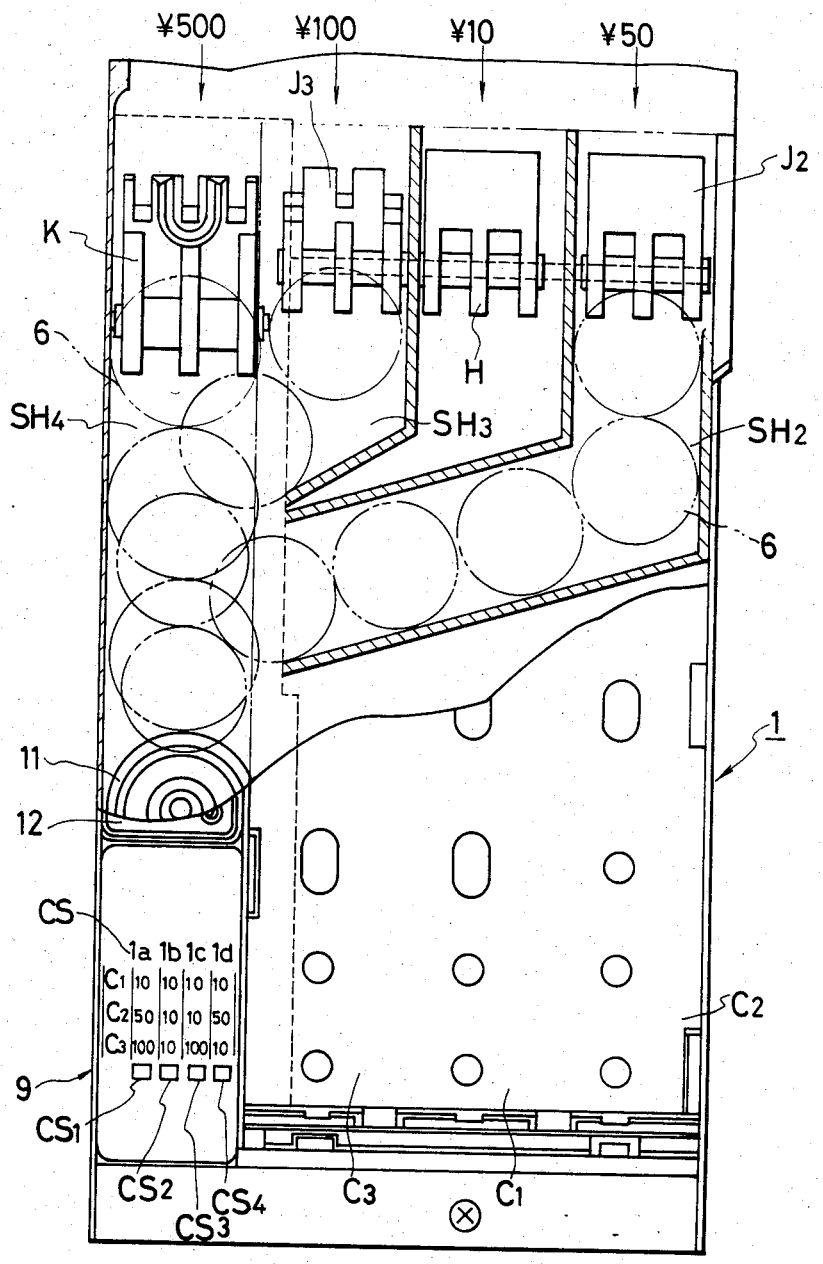
FIG. 11 is a view showing a coin dispensing apparatus according to a second embodiment of the present invention when a code setting means is incorporated in the coin dispensing apparatus.

FIG. 11 shows a second embodiment of the present invention. Unlike the first embodiment wherein the code setting section P consisting of the projections P1 to P3 formed on the coin tube cassette 1 and the code reading section Q formed as a code setting means on the coin dispensing apparatus 9 were provided so as to discriminate the type of coin tube cassette 1, a code setting means CS is arranged in the coin dispensing apparatus to set a type of coin tube cassette 1, instead of the code setting section P and the code reading section Q. Any other arrangement of the second embodiment is substantially the same as that of the first embodiment. The same reference numerals as in the second embodiment denote the same parts as in the first embodiment. Selection switches corresponding to the types of tube cassette 1 are arranged in the code setting means CS. In this embodiment, four selection switches CS1 to CS4 corresponding to four types of tube cassette 1*a* to 1*d* are arranged, so that the four types of tube cassette 1*a* to 1*d* can be selectively mounted in the coin dispensing apparatus. The coin tube cassette 1*a* used in the coin dispensing apparatus 9 according to the second embodiment comprises coin tubes C1 to C3 of the first type. ¥10, ¥50 and ¥100 coins are stored and replenished in the coin tubes C1 to C3, respectively. The coin tube cassette 1*b* comprises a ¥10 coin tube C1 of the first type, and ¥10 and ¥10 coin tubes C2 and C3 of the second type. The coin tube cassette 1*c* comprises ¥10 and ¥100 coin tubes C1 and C3 of the first type and a ¥10 coin tube of the second type. The coin tube cassette 1*d* comprises a ¥10 coin tube of the first type, a ¥50 coin tube of the first type and a ¥10 coin tube of the second type.

When one of the selection switches CS1 to CS4 is turned on in accordance with one of the four types of coin tube cassette 1*a* to 1*d* which are mounted in the coin dispensing apparatus 9, the control circuit is operated in the same manner as in the first embodiment. Differences between the operation flows of FIGS. 8 to 10 of the first embodiment and those of the second embodiment are as follows. In step S1, the CPU 21 checks whether or not the selection switch CS1 is turned on instead of performing the detection whether or not the reading code is given to be "100". Similarly, in step S2, the CPU 21 checks whether or not the selection switch CS2 is turned on; and in step S3, the CPU 21 checks whether or not the selection switch CS3 is turned on. Any other step for the operation of the second embodiment is the same as that of the first embodiment, and a detailed description thereof will be omitted. Even if the coin tube cassette 1*d* having the coin tubes C1, C2 and C3 for respectively storing the ¥10, ¥50 and ¥10 coins is used, a similar operation to that of the first embodiment is performed.

Three types of coin tube cassette are selectively used in the first embodiment, and four types of coin tube cassette are selectively used in the second embodiment. Seven coin tube cassettes each having three coin tubes are considered, and 10 combinations of coins are stored in the seven coin tube cassettes as follows:

TABLE 1

| | Tube type | | | Coins ( ) Tube | | | |
|---|---|---|---|---|---|---|---|
| Cassette | C1 | C2 | C3 | C1 | C2 | C3 | Selection switch |
| 1a | A | A | A | 10 | 50 | 100 | a |
| 1d | A | A | B | 10 | 50 | 10 | b |
| | | | | 10 | 50 | 50 | c |
| 1c | A | B | A | 10 | 10 | 100 | d |

TABLE 1-continued

| Cassette | Tube type C1 | C2 | C3 | Coins ( ) Tube C1 | C2 | C3 | Selection switch |
|---|---|---|---|---|---|---|---|
| | | | | 10 | 100 | 100 | e |
| 1b | A | B | B | 10 | 10 | 10 | f |
| 1e | B | A | A | 50 | 50 | 100 | g |
| | | | | 100 | 50 | 100 | h |
| 1f | B | A | B | 50 | 50 | 50 | i |
| 1g | B | B | A | 100 | 100 | 100 | j |

(A and B denote first and second type coin tubes, respectively.)

In Table 1, the cassette 1c indicates that the coin tubes C1 and C3 are of the first type and the coin tube C2 is of the second type, and that the coin tubes C1 and C3 store ¥10 and ¥100 coins and the coin tube C2 stores ¥10 or ¥100 coins. As a result, 10 selection switches a to j are required, as shown in Table 1. In this manner, seven tube cassettes may be used and the 10 selection switches may be arranged to obtain combinations shown in Table 1. Furthermore, the 10 selection switches a to j need not be arranged. For example, a slide switch may be arranged for each of the coin tubes C1, C2 and C3 so as to select one of the ¥10, Y50 and Y100 coin positions.

In the first embodiment, four projections P1 to P4 may be formed in the code setting section P, and a corresponding reading section is arranged to generate codes corresponding to the selection switches a to j.

FIGS. 12 to 15 show a third embodiment of the present invention. Unlike in each of the first and second embodiments wherein the selection mechanisms are provided for the corresponding coins selectively dispensed from the coin tubes C1 to C3 and the coin storage shoots SH2 to SH4, only two solenoids are used to drive the selection mechanism for selectively dispensing the coin tubes C1 to C3 and the coin storage shoots SH2 to SH4 according to the third embodiment.

The shoot coin discharging unit 10 shown in FIG. 6 is driven by solenoids SOL1 an SOL2 to discharge coins from the coin tubes C1 to C3.

Figure 12:
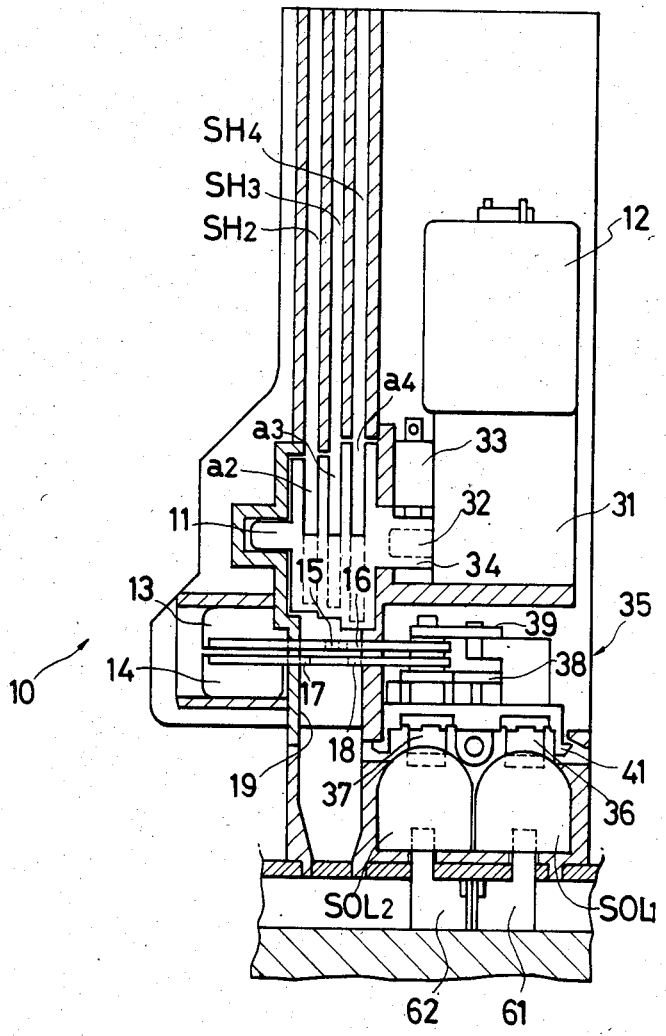
FIG. 12 is a view showing a coin dispensing apparatus having a coin dispensing mechanism for dispensing coins from the coin tube and the coin shoot according to a third embodiment of the present invention.
Figure 13:
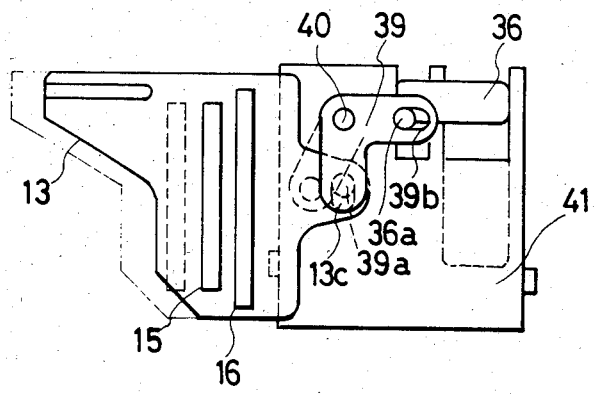
FIGS. 13 and 14 are respectively views for explaining the operation of a coin selection plate in the apparatus according to the third embodiment of the present invention.
Figure 14:
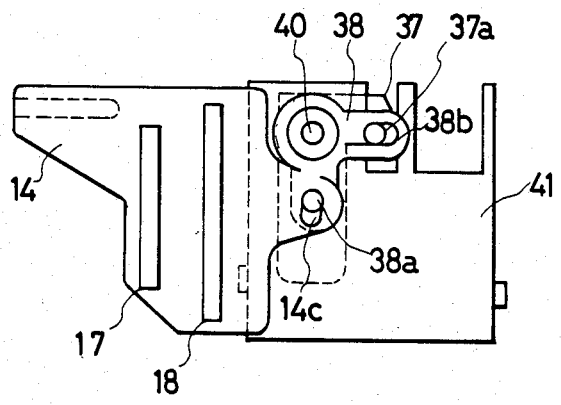
Figure 15:
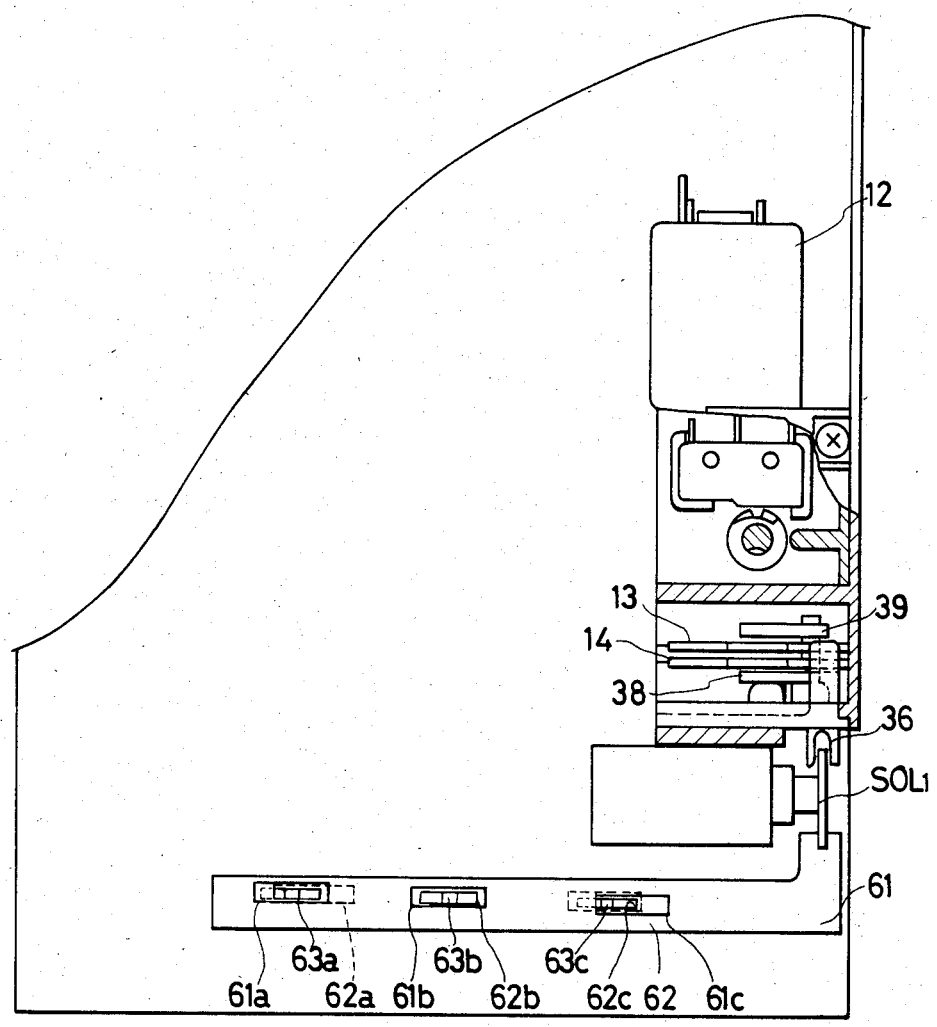
FIG. 15 is a view showing a coin dispensing mechanism for dispensing coins from the coin tube and the coin shoot.

The coin discharging unit for discharging coins from the coin tubes C1 to C3 has the same arrangement as the conventional mechanism, and a detailed description thereof is omitted. Only change levers 61 and 62 for selecting coins from the coin tubes C1 to C3 are illustrated. A coin discharging mechanism 10 for discharging coins from the coin storage shoots SH2 to SH4 has a rotary drum 11 having grooves a2, a3 and a4 for receiving coins from the shoots SH2 to SH4. The rotary drum 11 is fixed on a rotating shaft 32 of the rotary drum 11. The rotating shaft 32 is driven by a motor 12 through a transmission mechanism 31. A carrier switch 33 is engaged with a cam 34 on the rotary drum 11 and detects one revolution of the rotary drum 11. Reference numerals 13 and 14 denote coin selection plates, respectively. In the same manner as the plates shown in FIG. 6, the coin selection plate 13 has slits 15 and 16, and the coin selection plate 14 has slits 17 and 18. The coin selection plates 13 and 14 are respectively driven by first and second solenoids SOL1 and SOL2 through a transmission mechanism 35 along the right-and-left direction in FIG. 12. As shown in FIGS. 13 and 14, the coin selection plate 13 has an aperture 13c which can receive a pin 39a at one end of a first L-shaped lever 39. The first L-shaped lever 39 is pivotal about a shaft 40 fixed on a plate 41 which is then fixed on a chassis of the coin dispensing apparatus. The other end of the first L-shaped lever 39 has an aperture 39b, and the aperture 39b is engaged with a pin 36a on the first lever 36. The first lever 36 is engaged with the first solenoid SOL1, as shown in FIGS. 12 and 15. When the first solenoid SOL1 is energized, the first lever 36 is moved downward in FIG. 13, so that the first L-shaped lever 39 is pivoted clockwise through the pin 36a and the aperture 39b. The first coin selection plate 13 is moved to the left (FIGS. 12 and 13) by engagement of the pin 39a and the aperture 13c.

Similarly, as shown in FIG. 14, an aperture 14c formed in the second coin selection plate 14 is engaged with a pin 38a extending at one end of a second L-shaped lever 38. The second L-shaped lever 38 is pivotal about a shaft 40. The other end of the second L-shaped lever 38 has an aperture 38b, and the aperture 38b is engaged with a pin 37a on a second lever 37, so that the second lever 37 is engaged with the second solenoid SOL2, as shown in FIG. 12. For this reason, when the second solenoid SOL2 is energized, the second lever 37 is moved downward in FIG. 14, and the second L-shaped lever 38 is pivoted about the shaft 40 clockwise. As a result, the second coin selection plate 14 is slid to the left in FIGS. 12 and 14.

In this manner, the first and second coin selection plates 13 and 14 are slid by the first and second solenoids SOL1 and SOL2. However, in the state (i.e., neither the first solenoid SOL1 nor the second solenoid SOL2 are energized) shown in FIGS. 12 to 14, a slit 16 of the first coin selection plate is located in the same position as a slit 18 of the second coin selection plate. At the same time, the slits 16 and 18 are located immediately under the groove a4 of the rotary drum 11 which stores a ¥500 coin. For this reason, when the rotary drum 11 is rotated, the ¥500 coin in the groove a4 is discharged from a coin discharge port 19 through the slits 16 and 18. However, the ¥50 coin stored in the groove a2 and the ¥100 coin stored in the groove a3 are blocked by the coin selection plates 13 and 14 and will not be discharged from the coin discharge port. However, when the first solenoid SOL1 is energized, the first coin selection plate 13 is moved to the left in FIGS. 12 and 13, so that a slit 15 in the first coin selection plate 13 is aligned with a slit 17 in the second coin selection plate 14. At the same time, the slits 15 and 17 are located immediately under the groove a2 in the rotary drum 11. As a result, only the ¥50 coin is discharged from the groove a2 to the coin discharge port 19. Similarly, when the second solenoid SOL2 is energized, the slits 15 and 18 are located immediately under the groove a3, and only the ¥100 coin is discharged from the groove a3 to the coin discharge port 19.

The coin discharging operation for discharging coins from the coin tubes C1 to C3 is the same as the conventional one. According to this embodiment, the change levers 61 and 62 of the coin discharging mechanism for discharging the coin tubes C1 to C3 are engaged with the first and second solenoids SOL1 and SOL2 for sliding the first and second coin selection plates 13 and 14, respectively. The change levers 61 and 62 can be slid by the first and second solenoids SOL1 and SOL2. In this manner, the first and second solenoids SOL1 and SOL2 are commonly used for the change levers 61 and 62, and the solenoid selection plates 13 and 14. When the first solenoid SOL1 is energized, the first coin selection plate 13 and the first change lever 61 are moved (FIG. 15). However, when the second solenoid SOL2 is energized, the second coin selection plate 14 and the second change lever 62 are moved. When the first and second solenoids SOL1 and SOL2 are not energized, an aperture 61*b* among apertures 61*a* to 61*c* in the first change lever 61 is aligned with an aperture 62*b* among apertures 62*a* to 62*c* in the second change lever 62, so that a change slide plate 63*b* can be slid. However, when only the first solenoid SOL1 is energized, the aperture 61*c* is aligned with the aperture 62*c* so that a change slide plate 63*c* can be slid. When only the second solenoid SOL2 is energized, the aperture 61*a* is aligned with the aperture 62*a* so that a change slide plate 63*a* can be slid. A coin is discharged from any one of the coin tubes C1 to C3 which corresponds to aperture alignment.

When the motor for the coin discharging mechanism is driven to selectively discharge a coin from the coin tubes, the first and second solenoids SOL1 and SOL2 are selectively energized to align a pair of apertures among the apertures 61*a* to 61*c* and 62*a* to 62*c*. The change slide plate corresponding to the pair of aligned apertures is slid by the motor for the coin discharging mechanism, so that a coin is discharged from the corresponding coin tube. When a coin is discharged from the coin storage shoot, the motor 12 for the coin discharging mechanism 10 is driven to selectively energize the first and second solenoids SOL1 and SOL2. In this manner, a coin can be discharged from the rotary drum 11. According to the third embodiment of the present invention, the solenoid as the coin selecting means is commonly used for the coin discharging mechanisms for discharging coins from the coin tube and the coin storage shoot.

In the first to third embodiments, the coin storage shoot is arranged in the coin dispensing apparatus. However, the coin storage shoot may be arranged in the coin tube cassette.

What is claimed is:

1. A coin dispensing apparatus, comprising:

a coin tube cassette detachably mounted in said coin dispensing apparatus, said cassette having a plurality of coin tubes for storing coins in a direction of thickness of said coins;

code setting means for setting a code indicative of a combination of denomination of coins stored in said plurality of coin tubes; and controlling means for controlling coin dispensing on said code set by said code setting means so as to selectively dispense at least one coin consisting of at least one denomination.

2. An apparatus according to claim 1, wherein said coin tube cassette comprises a combination of a first type coin tube having a coin selector gate for automatically replenishing said first type coin tube until said first type coin tube becomes full with coins inserted in said coin dispensing apparatus, and a second type coin tube which is not subjected to automatic replenishing of the coins inserted in said coin dispensing apparatus.

3. An apparatus according to claim 1, wherein said coin tube cassette comprises only a first type coin tube having a coin selector gate for automatically replenishing said first type coin tube until said first type coin tube becomes full with coins inserted in said coin dispensing apparatus.

4. An apparatus according to claim 1, wherein said code setting means comprises a code generation section arranged in said coin tube cassette for generating said code, and a code reading section for reading the code from said code generating section.

5. An apparatus according to claim 1, wherein said code setting means comprises selection switches operable to indicate said combination of the denomination of coins stored in said plurality of tubes.

6. A coin dispensing apparatus, comprising:

a plurality of coin shoots each adapted to store coins in a radial direction of said coins, and having a coin dispensing ports, said plurality of coin shoots being disposed in a manner that at least their coin dispensing ports are juxtaposed in a direction of thickness of said coins;

rotary drum means disposed opposite said coin dispensing ports and formed with grooves which are juxtaposed with each other, each of said grooves being in alignment with a corresponding one of said coin dispensing ports for receiving a coin dispensed from said corresponding port;

a first driving means for rotatively driving said rotary drum means;

at least one coin selection plate disposed beneath said rotary drum means and slidable in a direction along which said grooves are juxaposed, said at least one coin selection plate being formed therein with a slit which is selectively aligned with one of said grooves in dependence on a slide position of said selection plate, so as to pass therethrough a coin received in said aligned groove; and a second driving means for causing said at least one coin selection plate to slide.

7. An apparatus according to claim 6, wherein said coin dispensing apparatus includes a plurality of coin tubes for storing coins in a direction of thickness of said coins, and change lever means adapted to selectively assume one of its operational positions for allowing coin dispensing from a corresponding one of said plurality of coin tubes, said second driving means comprising solenoid means opratively connected with said coin selection plate for controlling the operational position of said change lever means.

8. A coin dispensing apparatus for selectively dispensing a coin from a plruality of coin tubes for storing coins in a direction of thickness thereof, comprising:

a coin tube cassette having a plurality of coin tubes and detachably mounted in said coin dispensing apparatus;

code setting means for setting code of said tube cassette in accordance with deominations of said coins stored in said plurality of coin tubes;

controlling means for controlling coin dispensing in response to a signal from said code setting means;

said coin tube cassette comprising a combination of a first type coin tube having a coin selector gate for automatically replenishing said first type coin tube until said first type coin tube becomes full with coins inserted in said coin dispensing apparatus, and a second type coin tube which is not subjected to automatic replenishing of the coins inserted in said coin dispensing apparatus; and said second type coin tube having a coin selector gate, said coin selector gate being operated to supply coins inserted in said coin dispensing apparatus to a coin shoot for storing coins in a radial direction thereof until said coin shoot becomes full.

9. A coin dispensing apparatus for selectively dispensing a coin from a plurality of coin tubes for storing coins in a direction of thickness thereof, comprising:

a coin tube cassette having a plurality of coin tubes and detachably mounted in said coin dispensing apparatus;

code setting means for setting code of said tube cassette in accordance with denomination of said coins stored in said plurality of coin tubes;

controlling means for controlling coin dispensing in response to a signal from said code setting means;

said coin tube cassette comprising a combination of a first type coin tube having a coin selector gate for automatically replenishing said first type coin tube until said first type coin tube becomes full with coins inserted in said coin dispensing apparatus, and a second type coin tube which is not subjected to automatic replenishing of the coins inserted in said coin dispensing apparatus; and said coin tube cassette having a coin shoot for storing coins in a radial direction thereof, said coin shoot being arranged in correspondence to said second type coin tube and being automatically replenished with coins upon operation of a coin selector gate.

10. An apparatus according to claim 8 or 9, wherein said code setting means operates to set a code which corresponds to a combination of denominations of said coins stored in said coin tubes and a combination of types of said coin tubes.

* * * * *